US005306008A

United States Patent [19]

Kinoshita

[11] Patent Number: 5,306,008

[45] Date of Patent: Apr. 26, 1994

[54] MOMENTUM TRANSFER GOLF CLUB

[76] Inventor: Frank Kinoshita, P.O. Box 3164, Rancho Santa Fe, Calif. 92067

[21] Appl. No.: 940,460

[22] Filed: Sep. 4, 1992

[51] Int. Cl.[5] ..... A63B 53/04

[52] U.S. Cl. ..... 273/164.1; 273/167 F; 273/169; 273/175; 273/80 A

[58] Field of Search ..... 273/167 R–167 K, 273/77 R, 77 A, 164.1, 187.6, 80 A

[56] References Cited

U.S. PATENT DOCUMENTS

| | | | |
|---|---|---|---|
| 1,133,129 | 3/1915 | Govan | 273/171 |
| 1,485,272 | 2/1924 | Kinsman | 273/164.1 |
| 1,503,291 | 7/1924 | Rimmer | 273/169 X |
| 1,525,148 | 2/1925 | Pickop | 273/167 G |
| 1,654,916 | 1/1928 | Boyce | 273/168 X |
| 1,671,956 | 5/1928 | Sime | 273/169 |
| 1,969,086 | 8/1934 | Luckett | 273/164.1 X |
| 1,993,982 | 3/1935 | Glover | 273/167 F |
| 2,842,369 | 7/1958 | East | 273/164.1 |
| 2,859,972 | 11/1958 | Reach | 273/164.1 |
| 3,042,405 | 7/1962 | Solheim | 273/168 X |
| 3,059,926 | 10/1962 | Johnstone | 273/77 |
| 3,212,783 | 10/1965 | Bradley et al. | 273/167 F |
| 3,860,244 | 1/1975 | Cosby | 273/167 F |
| 3,873,094 | 3/1975 | Sebo et al. | 273/167 R X |
| 3,941,390 | 3/1976 | Hussey | 273/169 |
| 3,947,041 | 3/1976 | Barber | 273/167 G |
| 3,955,820 | 5/1976 | Cochran | 273/167 F |
| 3,980,301 | 9/1976 | Smith | 273/80.2 |
| 4,063,737 | 12/1977 | Tom | 273/174 |
| 4,214,754 | 7/1980 | Zebelean | 273/167 H |
| 4,247,105 | 1/1981 | Jeghers | 273/77 A |
| 4,322,083 | 3/1982 | Imai | 273/167 F |
| 4,417,731 | 11/1983 | Yamada | 273/167 H |
| 4,420,156 | 12/1983 | Campau | 273/77 A |
| 4,444,395 | 4/1984 | Reiss | 273/171 |
| 4,471,961 | 9/1984 | Masghati | 273/175 |
| 4,512,577 | 4/1985 | Solheim | 273/77 A |
| 4,553,755 | 11/1985 | Yamada | 273/171 |
| 4,607,846 | 8/1986 | Perkins | 273/167 H X |
| 4,621,813 | 11/1986 | Solheim | 273/77 A |
| 4,650,191 | 3/1987 | Mills | 273/169 X |
| 4,762,322 | 8/1988 | Molitor | 273/77 A |
| 4,826,172 | 5/1989 | Antonious | 273/167 H X |
| 4,828,266 | 5/1989 | Tunstall | 273/167 H X |
| 4,854,581 | 8/1989 | Long | 273/77 A |
| 4,869,507 | 9/1989 | Sahm | 273/171 |
| 4,872,684 | 10/1989 | Dippel | 273/167 C X |
| 4,895,367 | 1/1990 | Kajita | 273/77 A |
| 4,962,932 | 10/1990 | Anderson | 273/171 |
| 5,072,941 | 12/1991 | Klein | 273/174 X |
| 5,094,457 | 3/1992 | Kinoshita | 273/167 G |
| 5,131,656 | 7/1992 | Kinoshita | 273/164 |

FOREIGN PATENT DOCUMENTS

| | | | |
|---|---|---|---|
| 376277 | 6/1932 | United Kingdom | 273/164.1 |
| 439187 | 12/1935 | United Kingdom | 273/171 |

*Primary Examiner*—Mark S. Graham
*Assistant Examiner*—Sebastiano Passaniti

[57] ABSTRACT

This invention relates to a category of golf clubs ranging from the driver to a seven wood, and ranging from a one iron to high lofted sand wedges. Improved performance is achieved by giving proper consideration to the difference in the velocity of the club head toe relative to the velocity of the heel at impact. Also, to achieve improved transfer of the club head momentum to the golf ball, this invention uses a high moment of inertia interconnect 21 traversing through, or along, the horizontal plane intersecting the club head effective center of gravity, wherein said beam rigidly interconnects the heel-toe mass sections. These improvements will enhance the playability of these golf clubs by providing golf clubs affording increased distance with less dispersion.

20 Claims, 3 Drawing Sheets

MOMENTUM TRANSFER GOLF CLUB

BACKGROUND OF THE INVENTION

The present invention relates to a category of golf equipment known as an iron or a wood golf club. There is clearly a continuing need for improvement in the playability of golf equipment. As well known to those who know the game of golf, generally the strokes taken to get the ball on the green accounts for more than half of a golfer's total score. It is the intent of the present invention to provide the golfer with iron and wood clubs affording dynamic balancing with respect to the expected impact point. Also to provide improved transfer of the club head momentum to the golf ball. These improvements, dynamic balancing and improved momentum transfer will aid the golfer in propelling the golf ball towards the green. The present invention's goal is to reduce the number of strokes taken by the golfer to complete a round of golf. Toward this end, the golf club constraints are broad as far as the golf club head material, weight, loft and lie angles are concerned. The golf club woods will range from a number one wood to a number seven wood. The golf club irons will range from a number one iron to high-lofted sand wedges.

OBJECT OF THE INVENTION

To provide golf clubs that afford dynamic balancing with respect to the expected impact point. Also, to provide golf clubs affording improved transfer of the golf club head momentum to the golf ball. The golf clubs of the present invention afford superior playing characteristics compared to prior art golf clubs. The dynamic balancing of the golf club head or improved momentum transfer affords longer distance with less dispersion in the flight of the golf ball. Said superior playing characteristics are obtained by employing the features discussed herein:

(A) To provide club heads that utilize unique dynamic balancing with respect to the expected impact point. The expected impact point will be located on the vertical plane intersecting the midpoint of the heel and toe boundary limits of the club face. Dynamic balancing is obtained by taking into consideration the different velocities associated with different parts of the club head at impact. In a delayed hit golf swing, the toe section center of gravity velocity will be approximately 10 percent greater than the heel section center of gravity velocity at the time of impact. The delayed hit golf swing is defined as a golf swing that exhibit these conditions. The golfer maintains a cocked wrist position until approximately the last 90 degrees of swing arc just prior to impact, and in this cocked wrist position the club face is parallel to and on the swing plane, and at impact the club face is perpendicular to the swing plane. In other words, the golfer is force to rotate the club shaft 90 degrees, during the last 90 degrees of swing arc, to bring the club head into the proper hitting position. U.S. Pat. No. 5,094,457, page 3 also defines the delayed hit. Also to achieve dynamic balancing, the actual moment of the momentums of the heel and toe sections are set to be equal. As a first order approximation, empirical data shows that the initial velocity of the golf ball is a function of the club head velocity. Also, the initial velocity of tbe the golf ball can be expressed as a function of club head momentum mv.

m=club head mass.

v=velocity of club head.

Since the golfer is seeking a "twist free" condition at impact, the club head is designed so that the moment of the toe section momentum is equal to moment of the heel section momentum. In equation form, $$M_T \times m_T v_T = M_H \times m_H v_H.$$

$M_T$=moment of the toe section=distance from the toe section center gravity to the vertical plane intersecting the effective center of gravity of the club head, wherein said vertical plane is perpendicular to the club face.

$m_T$=mass of the toe section.

$v_T$=velocity of the toe section at impact.

$M_H$=moment of the heel section=distance from the heel section center gravity to the vertical plane intersecting the effective center of gravity of the club head, wherein said vertical plane is perpendicular to the club face.

$m_H$=mass of the heel section.

$v_H$=velocity of the heel section at impact.

The equation $M_T \times m_T v_T = M_H \times m_H v_H$ defines dynamic balancing for the present invention. Since all club heads of the present invention afford dynamic balancing, playability of these clubs will be enhanced by affording longer distance with less dispersion.

(B) To further enhance the playability of the golf clubs of the present invention, the longer clubs (smaller numbered clubs) are designed to provide a lesser amount of rotational moment of inertia about the shaft longitudinal axis. Since the lesser amount of rotational moment of inertia for longer clubs will be offset (compensated) by the higher centrifugal force generated by the higher velocity of the longer clubs, the rotational force required by the golfer, to bring the club head into the hitting position, will be substantially constant for all clubs.

(C) To provide golf clubs or club heads that have an unique interconnect beam. This unique interconnect beam is used to rigidly interconnect the heel and toe mass sections. This unique interconnect beam is a structure affording high moment of inertia along the club head's front to back dimension. At substantially the mid-point of the heel and the toe mass sections, the beam traverses through the horizontal plane intersecting the club head's effective center of gravity. Since the heel and toe mass sections are rigidly interconnected to each other through this high moment of inertia beam, improved transfer of the heel and toe mass momentum to the golf ball will be realized compared to prior art golf clubs. Prior art heel and toe weighted golf club heads are devoid of a high moment of inertia beam, wherein said beam traverses through, or along, the horizontal plane intersecting the center of gravity. Prior art seems to imply that the momentum of the heel and toe mass will be transferred to the golf ball through the sole flange, through the thin striking face plate, and/or through the rim of the club head. Specifically, U.S. Pat. Nos. 4,420,156 and 4,621,813 do not describe or claim a high moment of inertia beam which passes through, or along, the horizontal plane intersecting the club head center of gravity. I am not aware of any prior art, either in patents or the marketplace, where a heel-toe weighted golf club head utilizes a truly high moment of inertia beam to interconnect the heel-toe mass sections, wherein the beam traverses through, or along, the horizontal plane intersecting the club head center of gravity. The present invention's high moment of inertia beam aids the attainment of a truly rigid connection of the heel and toe mass sections so that improved transfer of the heel-toe mass momentum to the golf ball will be realized.

(D) To provide an unique heel-toe weighted golf club head configuration that truly affords a high radius of gyration. Radius of gyration is well discussed in U.S. Pat. No. 4,420,156. High radius of gyration will reduce the adverse effects of directional loss and momentum transfer loss caused by off-centered impacts along the heel-toe dimension. Since the present invention's unique heel-toe weighted sections are rigidly attached to each other through its high moment of inertia beam structure, a large sweet spot along the heel-toe dimension is realized. The center of gravity of the high moment of inertia beam, heel and toe mass sections is uniquely located on the horizontal plane intersecting the center of gravity of the remainder of the club head. In other words, there is correspondence between the center of gravities of these two components of the club head.

(E) To provide a high moment of inertia interconnect beam that forms a rigid connection between the heel-toe weighted sections and the impact point. The term moment of inertia as applied to the interconnect beam could be referred to as the "second moment of area", but since the term moment of inertia is used in beam deflection analysis, the term moment of inertia will be used here. In other words, when the term moment of inertia is used in conjunction the term interconnect beam, interconnect, interconnect structure, or beam, we mean the "second moment of area". Said interconnect beam is thin in the vertical dimension in order to keep its weight at a minimum, but is wide in the front to back dimension to obtain high front to back moment of inertia. In beam analysis, deflection$=5wl^4/384EI$ for the case where the beam is supported on both ends. E=-Modulus of Elasticity. Modulus of Elasticity of steel is approximately 29,000,000 psi. I=moment of inertia$=bh^3/12$, b is the vertical thickness of the interconnect beam, h is the rearward dimension of the interconnect beam. It can be seen from the beam deflection equation given above that for a given set of conditions, deflection is inversely proportional to the moment of inertia. Since the moment of inertia of the interconnect beam is related to the cube power of its rearward dimension, it is essential that a large rearward dimension be maintained to realize a club head affording negligible deflection. With an ideal golf stroke and zero deflection, all of the heel-toe mass momentum will be transferred to the golf ball. Without a high moment of inertia interconnect beam, deflection of the club head will occur with loss of momentum transfer. Hence, it is imperative that a high moment of inertia interconnect beam be utilized.

A high radius of gyration club head that does not rigidly interconnect its heel-toe mass sections, does not afford an elongated sweet spot along the heel-toe dimension. An authority states that: "For golf balls contacted more than ¼ inch from the sweet spot while the other parameters were in perfect order, putts of 8 feet or greater would miss 95 percent of the time."[Dave Pelz in Putt Like The Pros, Harper Perennial (1989), p 71]. This statement emphasizes the need for a high radius of gyration club head that undergoes a negligible amount of deflection at impact. Dave Pelz's statement refers to putts, but it is just as important, if not more important, to have a truly high radius of gyration wood and iron club heads designed for impulse conditions. It appears that prior art has ignored the importance or using a high moment of inertia beam to interconnect the heel-toe mass sections, wherein said beam traverses through, or along, the horizontal plane intersecting the center of gravity.

(F) In one embodiment of the present invention, to further facilitate the use of the golf clubs, a mark or marks will be placed on the crown to indicate the locus or loci of the vertical plane intersecting the effective center of gravity and the surface of the crown. Alternately, or in conjunction with the crown mark(s), marking or markings will be located on the club face to show the location of the effective center of gravity as viewed from the front of the club face. All mark(s) will be downwardly visible from the top of the club head.

(G) It is not universally recognized (see U.S. Pat. No. 4,322,083 FIG. 3) that maximum momentum is transferred to the golf ball when the club head center of gravity is located on a horizontal plane behind the impact point. U.S. Pat. No. 5,131,656, FIG. 6, page 10 shows that when the club head center of gravity is on the same horizontal plane as the impact point, maximum momentum is transferred to the golf ball.

SUMMARY OF THE INVENTION

It is an object of the present invention to provide a golf club comprised of a club head, a shaft, and a grip; or just a club head. Said club head is rigidly shaped to define a club face, a heel, a sole, a toe, a crown (top surface), a hosel, a heel section, and a toe section. In one embodiment, said club head will also be rigidly shaped to define a heel mass section, a toe mass section, and an interconnect beam. The heel mass section, the toe mass section, and the interconnect beam will not be visible from the outside in the case of hollow wood clubs.

The present invention's golf clubs or club heads affords dynamic balancing in regards to the expected impact point. The expected impact point will be located on the vertical plane intersecting the midpoint of the heel and toe boundary limits of the club face, wherein said vertical plane is perpendicular to the club face. Dynamic balancing is obtained by taking into consideration the different velocities associated with different parts of the club head at impact. In a delayed hit golf swing, the toe section center of gravity velocity will be approximately 10 percent greater than heel section center of gravity velocity at the time of impact. Given that the club head is a rigid body and that the club shaft is rotated 90 degrees during the last 90 degrees of swing arc just prior to impact, the club head toe velocity must be greater than the club head heel velocity at impact. In other words, since the club head toe has to "catch-up" to the club head heel during the delayed hit, the club head toe velocity has to be greater than the club head heel velocity at impact. In fact the difference in the toe-heel center of gravity velocities is approximated by:

$$2[(3.14159/2)r_T-(3.14159/2)r_H]/t=\text{difference in feet/second.}$$

$r_T$=distance in feet measured along the horizontal plane from the longitudinal shaft axis to the toe section center of gravity.

$r_H$=distance in feet measured along the horizontal plane from the longitudinal shaft axis to the heel section center of gravity.

t=time in seconds from the time golfer first entered the delayed hit zone (90 degrees of swing arc just prior to impact) to the time of impact. Using the case where the average club head velocity in the delayed hit zone is 75 MPH (110 feet/second), the time spent in the delayed hit zone=0.057 seconds. If $r_T$=2.35 inches=0.196 feet and $r_H$=zero, we have 2[(3.14159/2)0.196]/0.057=10.80 feet/-second. Stating this difference as a ratio, we have (110+10.80)/110=1.098. Dynamic balancing is the case when the toe section moment of momentum equals the heel section moment of momentum, wherein the moments are referenced to the vertical plane intersecting the effective center of gravity. In equation form, $$M_T \times m_T v_T = M_H \times m_H v_H.$$

$M_T$=moment of the toe section=distance from the toe section center gravity to the vertical plane intersecting the effective center of gravity of the club head, wherein said vertical plane is perpendicular to the club face.

$m_T$=mass of the toe section.

$v_T$=velocity of the toe section at impact.

$M_H$=moment of the heel section=distance from the heel section center gravity to the vertical plane intersecting the effective center of gravity of the club head, wherein said vertical plane is perpendicular to the club face.

$m_H$=mass of the hell section.

$v_H$=velocity of the heel section at impact.

Since all club heads of the present invention afford dynamic balancing, playability of these clubs will be enhanced yielding longer distance with less dispersion.

To provide a golf club that affords improved transfer of the club head momentum to the golf ball compared to prior art golf clubs. This improved momentum transfer will provide increased distance with less dispersion. This improved momentum transfer is achieve by using a high moment of inertia beam to rigidly interconnect the heel mass section to the mass sections. At substantially the mid-point of the heel and the toe mass sections, the beam traverses through the horizontal plane intersecting the club head's effective center of gravity. The heel and toe mass sections, and the interconnect beam is intrinsic to the club head. Since the heel and toe mass sections are rigidly interconnected to each other through this high moment of inertia beam, improved transfer of the heel and toe mass momentum to the golf ball will be realized. Prior art heel and toe weighted golf club heads are devoid of a high moment of inertia beam, wherein said beam traverses through, or along, the horizontal plane intersecting the center of gravity.

To provide an unique heel-toe weighted golf club head configuration that truly affords a high radius of gyration. Radius of gyration is well discussed in U.S. Pat. No. 4,420,156. High radius of gyration of a truly rigid body will reduce the adverse effects of directional loss and momentum transfer loss caused by off-centered impacts along the heel-toe dimension. Since the present invention's unique heel-toe weighted sections are rigidly attached to each other through its high moment of inertia beam, an elongation of the sweet spot along the heel-toe dimension is realized. The moment of inertia of a beam is define as: $I=bh^3/12$. In the present invention, b is the vertical thickness of the interconnect beam, and h is the rearward dimension of the interconnect beam (note that the effect of h is to the cube power). Since it is imperative that a high moment of inertia beam be utilized to minimize deflection at impact, the present invention specifies a minimum rearward (h) dimension of 0.5 inch. For the present invention a high moment of inertia beam is defined as a beam having a rearward dimension of not less than 0.5 inch. A high radius of gyration club head that does not rigidly interconnect its heel-toe mass sections, can not afford a maximized elongation of the sweet spot along the heel-toe dimension.

To further facilitate the use of the present invention's golf clubs, a mark or marks will be placed on the crown to indicate the locus or loci of the vertical plane intersecting the effective center of gravity and the surface of the crown. Alternately, or in conjunction with the crown mark(s), marking or markings will be located on the club face to show the location of the effective center of gravity as viewed from the front of the club face.

Dynamic balancing coupled with improved momentum transfer of these golf clubs of the present invention will provide superior and unique playing characteristic compared to prior art golf clubs due to the unique features listed as follows:

(a) Dynamic balancing of the club head is provided so that the effective center of gravity is located on a vertical plane intersecting the midpoint of the heel and toe boundary limits of the club face, wherein said vertical plane is perpendicular to then club face.

(b) A high moment of inertia beam is used to rigidly interconnect the heel and toe mass sections so that a club head affording negligible deflection at impact is provided.

(c) The high moment of inertia beam location is constrained so that at its midpoint, it passes through the horizontal plane intersecting the effective club head center of gravity so that improved momentum transfer to the golf ball is realized.

(d) Marking(s) is(are) provided on the crown and/or the club face to indicate the location of the effective club head center of gravity to further facilitate the golfer use of the golf clubs of the present invention.

(e) The longer clubs are designed to provide lesser amounts of rotational moment of inertia about the shaft axis. Due to the compensating effect of the higher centrifugal force associated with longer clubs, the rotational force exerted by the golfer will appear to be substantially the same for all clubs.

The unique features of the golf club or club head that are considered characteristic of the present invention are set forth in the appended claims. The invention will readily be understood from the following description when read in connection with the accompanying drawings.

DESCRIPTION OF PREFERRED EMBODIMENTS

Figure 1:
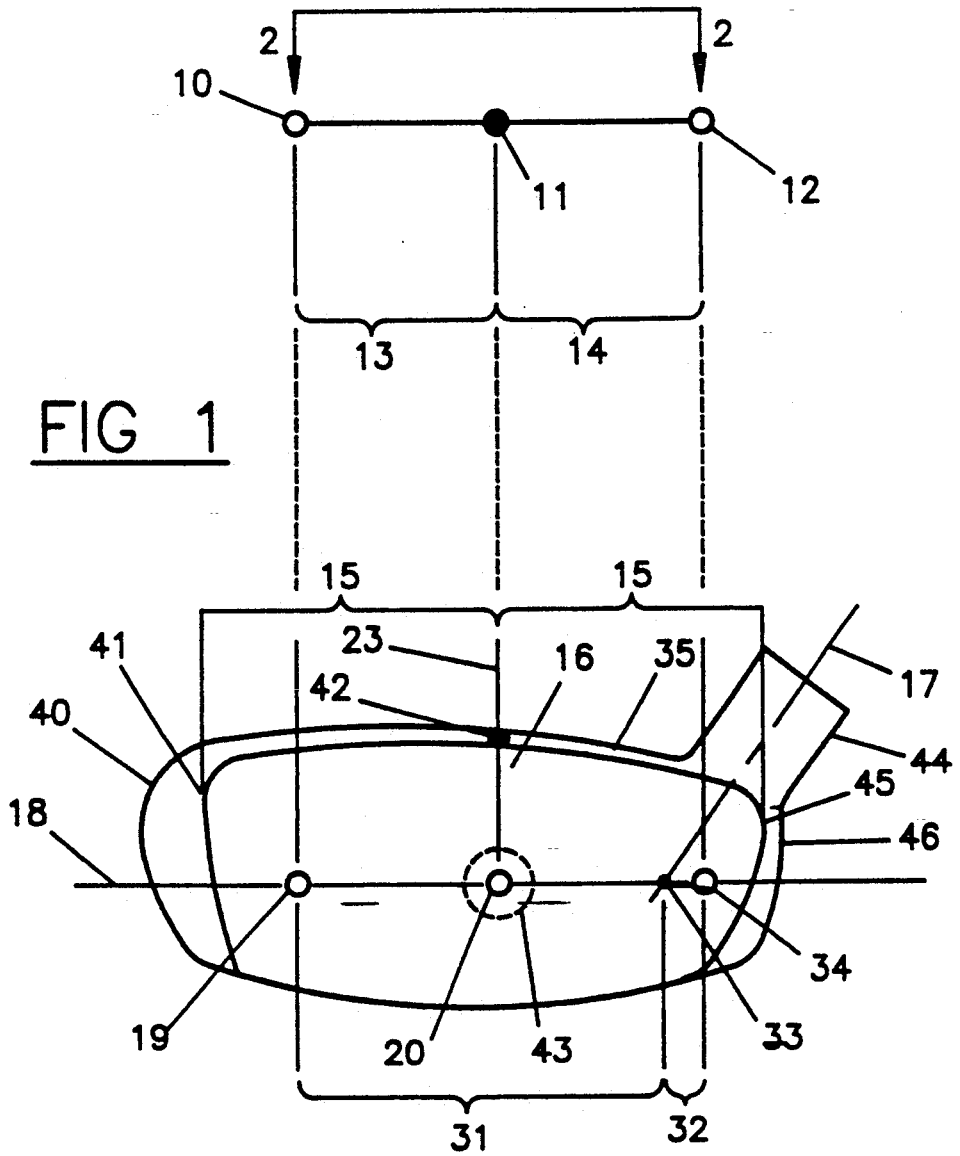
FIG. 1 is a moment of momentum diagram for the heel and toe sections as related to a wood club head and a front view of the wood club head of the present invention.

Referring to FIG. 1, the bottom half is a front view of the club face and the upper half is a diagram of the moment of momentum diagram for the heel and toe sections as related to a wood club head, wherein the moments are relative to the effective club head center of gravity 20. Center of gravity 20, the club head toe section center of gravity 19, and the heel section center of gravity 34 are projected onto the upper half of FIG. 1 to form the moment of momentum diagram. The momentum $m_T v_T$ 10 is toward the viewer of the drawing and is multiplied by the distance 13 to obtain its moment of momentum. The momentum $m_H v_H$ 12 is toward the viewer of the drawing and is multiplied by the distance 14 to obtain its moment of momentum.

$m_T$=mass of the toe section.

$v_T$=velocity of the toe section at impact.

$m_H$=mass of the heel section.

$v_H$=velocity of the heel section at impact.

The reaction of the golf ball 11 which is coincident to the vertical plane 23 is away from the viewer of the drawing and is the balance point for the moments of momentums generated by the momentums 10, 12, and the distances 13, 14. To obtain dynamic balancing as discussed in this disclosure, $$M_T \times m_T v_T = M_H \times m_H v_H.$$

$M_T$=moment of the toe section=distance from the toe section center gravity to the vertical plane intersecting the effective center of gravity of the club head, wherein said vertical plane is perpendicular to the club face.

$m_T$=mass of the toe section.

$v_T$=velocity of the toe section at impact.

$M_H$=moment of the heel section=distance from the heel section center gravity to the vertical plane intersecting the effective center of gravity of the club head, wherein said vertical plane is perpendicular to the club face.

$m_H$=mass of the heel section.

$v_H$=velocity of the heel section at impact.

The difference in the heel section center of gravity velocity and the toe section center of gravity velocity is equal to:

$$2[(3.14159/2)r_T-(3.14159/2)r_H]/t=\text{difference in feet/second.}$$

$r_T$=distance 31 in feet measured along the horizontal plane from the longitudinal shaft axis to the toe section center of gravity.

$r_H$=distance 32 in feet measured along the horizontal plane from the longitudinal shaft axis to the heel section center of gravity.

Using FIG. 1 as a basis, $r_T$=1.96 inches and $r_H$=−0.127 inch.

t=time in seconds from the time golfer first entered the delayed hit zone (90 degrees of swing arc just prior to impact) to the time of impact.

During the time t, the club head has undergone a rotation of 90 degrees about its longitudinal shaft axis. Using the case where the average club head velocity in the delayed hit zone is 75 MPH (110 feet/second), the time spent in the delayed hit zone is 0.057 seconds.

Since $r_T$=1.96 inches=0.163 feet and $r_H$=−0.127 inch=−0.0106 feet, $2[(3.14159/2)(0.163)-(3.14159/2)(-0.0106)]/0.057=-9.57$ feet/second.

The velocities of a rigid body can at any instant be described as the sum of the velocity of a reference point of the body plus a velocity due to rotation about an axis through the reference point. In this case, the club head is the rigid body and the longitudinal shaft axis intercept 33 of the horizontal plane 18 is said reference point. Individually the velocities are;

$[2[(3.14159/2)(0.163)]/0.057+110]$ feet/second=119 feet/second for the toe section center of gravity velocity, and $[2[(3.14159/2)(-0.0106)]/0.057+110]$ feet/second=109.4 feet/second for the heel section center of gravity velocity.

Using FIG. 1 as a basis, distance 10 is 1.02 inches and distance 12 is 1.10 inches. For a "twist free" condition at impact, $m_T \times 119 \times 1.02 = m_H \times 109.4 \times 1.10$. Or $m_H = 1.009\ m_T$. In other words, in this case, to have dynamic balancing, the mass of the heel section must be sightly greater than the mass of the toe section. The longitudinal shaft axis 17 is shown to intersect the horizontal plane 18 at point 33 which is marked with an X. The effective club head center of gravity 20 and the vertical plane 23 is shown to be equidistant 15 from the club face 16 heel boundary limit 45 and the toe boundary limit 41. The club head heel is shown as 46 and the club head toe is shown as 40. The hosel is shown as 44, the crown is shown as 35, the crown marking is shown as 42, and the club face marking is shown as 43.

Figure 2:
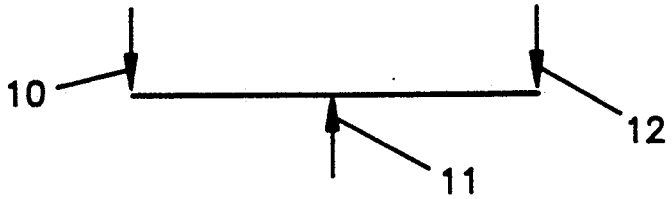
FIG. 2 is a plan view of the diagram shown in the upper half of FIG. 1 and shows the heel and toe section moments of momentums in relationship to the effective center of gravity, or the expected point of reaction of a golf ball.

FIG. 2 is a plan view of the diagram shown in the upper half of FIG. 1 and shows the heel and toe section moments of momentums in relationship to the reaction of a golf ball 11 which is coincident to vertical plane intersecting the effective center of gravity. The diagram shows the instantaneous situation at impact. It had been determined that the velocity of momentum 10 was 119/109.4 times greater than the velocity of momentum 12 for the case that was analyzed above.

Figure 3:
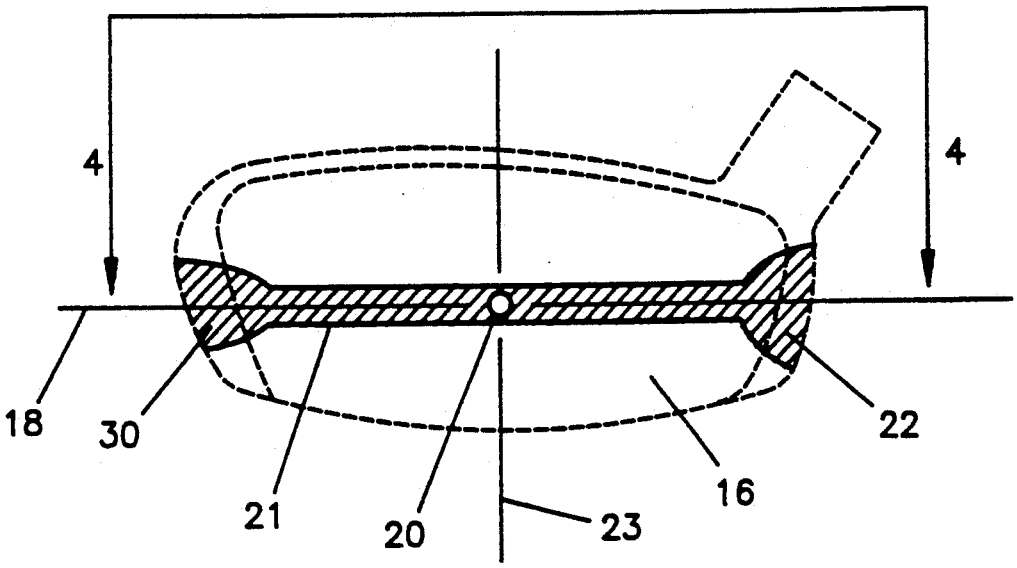
FIG. 3 is frontal view of the interconnect beam, heel and toe mass sections of a wood club head of the present invention.

FIG. 3 is frontal view of the interconnect beam, heel and toe mass sections of a wood club head of the present invention. The high moment of inertia beam 21 is shown interconnecting the toe section 30 to the heel section 22. The high inertia beam 21 is shown traversing along the horizontal plane 18 intersecting the effective club head center of gravity 20. The vertical plane 23 intersecting the effective center of gravity 20 is perpendicular to the club face 16.

Figure 4:
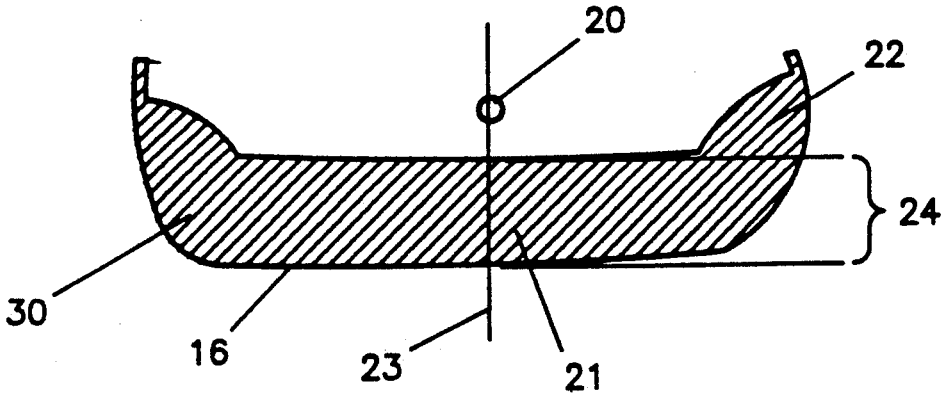
FIG. 4 is a sectional view of the interconnect beam, heel and toe mass sections of a wood club head taken at the horizontal plane intersecting the effective club head center of gravity.

FIG. 4 is a sectional view of the interconnect beam 21, heel mass section 22 and toe mass section 30 of a wood club head taken at the horizontal plane intersecting the effective club head center of gravity 20. As shown here, with hollow wood clubs, the effective center of gravity 20 will be located on the vertical plane 23 and behind the high moment of inertia beam 21. The moment of inertia of a beam is define as: $I=bh^3/12$. In the present invention, b is the vertical thickness of the interconnect beam, and h is the rearward dimension 24 relative the club face 16 as shown in this sectional view. Since it is imperative that a high moment of inertia beam be utilized to minimize deflection at impact, the present invention specifies a minimum rearward h dimension 24 of 0.5 inch. Note that the moment of inertia of a beam is a function of h to the cube power. A high radius of gyration club head that does not rigidly interconnect its heel-toe mass sections, can not afford a maximized elongation of the sweet spot along the heel-toe dimension.

Figure 5:
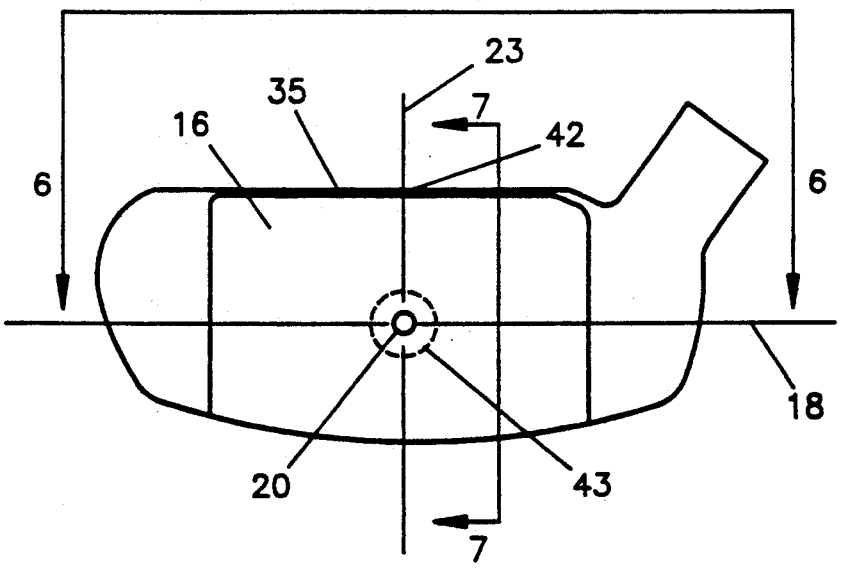
FIG. 5 is a front view of a number three iron of the present invention.

FIG. 5 is a front view of a number three iron of the present invention. The club head effective center of gravity 20 and the vertical plane 23 bisects the club face 16. The horizontal plane 18 is shown intersecting the effective center of gravity 20. The crown is shown as 35, the crown marking is shown as 42, and the club face marking is shown as 43.

Figure 6:
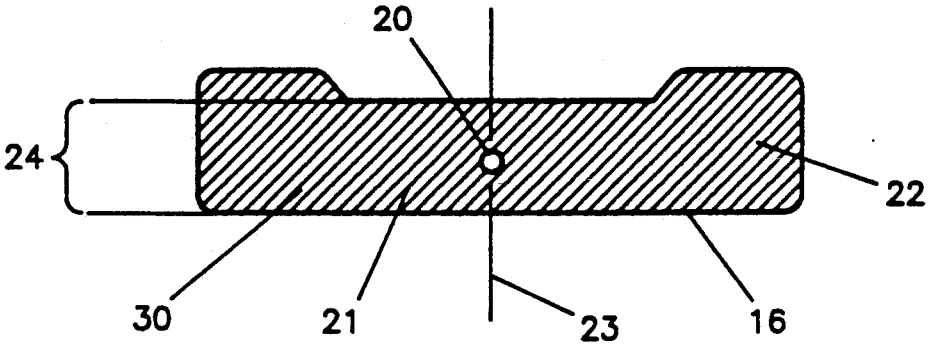
FIG. 6 is a sectional view of the interconnect beam, heel and toe mass sections of a number three iron club head, taken at the horizontal plane intersecting the effective club head center of gravity.

FIG. 6 is a sectional view of the interconnect beam 21, heel mass section 22 and toe mass section 30 of a number three iron club head taken at the horizontal plane 18 intersecting the effective club head center of gravity 20. The vertical plane 23 is shown perpendicular to the club face 16 and intersecting the effective center of gravity 20. The moment of inertia of a beam is define as: $I=bh^3/12$. Although the present invention specifies a minimum rearward h dimension 24 of 0.5 inch, the iron club heads of the present invention will have a typical rearward beam dimension 24 relative to the club face of at least 0.75 inch. A high radius of gyration club head that does not rigidly interconnect its heel-toe mass sections, can not afford a maximized elongation of the sweet spot along the heel-toe dimension.

Figure 7:
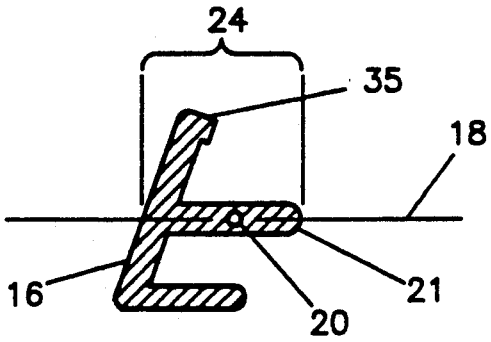
FIG. 7 is a sectional view of the number three iron club head taken at the vertical plane passing through its effective center of gravity.

FIG. 7 is a sectional view of the number three iron club head taken at the vertical plane 23 passing through the effective center of gravity 20. The sectional view shows the high moment of inertia beam 21 traversing through the horizontal plane 18 at the point where the effective center of gravity 20 is located. As shown by dimension 24 relative to the club face 16 the high moment of inertia beam 21 is seen to project substantially beyond the rear boundary limit of the crown 35.

In the discussion of the present invention, the club head is in its normal address position unless specified otherwise. Dynamic balancing is defined as the case where the effective center of gravity of the club head is at the midpoint of the club face toe and heel boundary limits and where, $M_T \times m_T v_T = M_H \times m_H v_H$. Effective center of gravity is the center of gravity determined by giving due consideration to the different velocities of the toe and heel sections at impact. The velocities of a rigid body can at any instant be described as the sum of the velocity of a reference point of the body plus a velocity due to rotation about an axis through the reference point.

While in the foregoing specification a detailed description of a specific embodiment of the invention was set forth for illustrative purposes, it will be understood that many of the parameters herein given may be varied by those skilled in the art without departing from the spirit and scope of the present invention.

I claim is:

1. A golf club comprising a rigid club head, a shaft and a grip;

said club head being rigidly shaped to define a club face, a heel, a sole, a toe, a crown, and a hosel, a heel section, a toe section, a toe mass section, a heel mass section, and an interconnect;

said club face having a front being adapted to strike a golf ball;

said club face having upper and lower edges, toe and heel boundary limits;

said heel being the portion of said club head where the sole and hosel meet;

said sole defining a bottom surface of said club head which normally rests on the ground when said golf club is held in the address position;

said toe being the part of the club head that is the farthest away from said heel of said club head;

said crown defining a curved top portion of said club head;

said hosel being that portion of said club head that is designed to interfit with said shaft;

said hosel being integrally attached to said club head;

said club head having an effective center of gravity substantially at the midpoint of the toe and heel boundary limits of said club face;

said heel section being the portion, of said club head, having boundary limits starting at a vertical plane intersecting the effective center of gravity and ending at a heel extremity;

said toe section being the portion, of said club head, having boundary limits starting at a vertical plane intersecting the effective center of gravity and ending at a toe extremity;

said vertical plane being perpendicular to said club face;

said effective center of gravity affording dynamic balancing so that the moment of the toe section momentum equals the moment of the heel section momentum at impact;

said heel section having a weight of from 1.05 to 1.15 greater than the weight of said toe section;

said toe mass section having a concentrated weight of from 7 to 30 percent of the weight of said club head and being located at the proximity of the toe;

said heel mass section having a concentrated weight of from 10 to 33 percent of the weight of said club head and being located at the proximity of the heel;

said interconnect rigidly connecting said toe mass section to the heel mass section, traversing substantially through a horizontal plane intersecting said effective center of gravity;

said interconnect being an intrinsic part of said club head and having a rearward dimension measured horizontally from the club face along said vertical plane of at least 0.5 inch affording a high moment of inertia interconnect;

said grip being adhesively attached to said shaft; and said shaft being attached to said club head.

2. The golf club of claim 1, wherein said crown of said club head has a mark or plurality of marks indicating the locus or loci between said vertical plane and the top portion of said crown.

3. The golf club of claim 1, wherein said club face has a distinguishing mark or plurality of marks indicating the location of said effective center of gravity as viewed from the front of said club face.

4. The golf club of claim 1, wherein said crown of said club head has a mark or plurality of marks indicating the locus or loci between said vertical plane and the top portion of said crown, and wherein said club face has a distinguishing mark or plurality of marks indicating the location of said effective center of gravity as viewed from the front of said club face.

5. The golf club of claim 1, wherein the club face has a roll radius of 8 inches to 50 inches and a bulge radius of 8 inches to 50 inches.

6. A golf club comprising a rigid club head, a shaft and a grip;

said club head being rigidly shaped to define a club face, a heel, a sole, a toe, a crown, and a hosel, a heel section, a toe section;

said club face having a front being adapted to strike a golf ball;

said club face having upper and lower edges, toe and heel boundary limits;

said heel being the portion of said club head where the sole and hosel meet;

said sole defining a bottom surface of said club head which normally rests on the ground when said golf club is held in the address position;

said toe being the part of the club head that is the farthest away from said heel of said club head;

said crown defining a curved top portion of said club head;

said hosel being that portion of said club head that is designed to interfit with said shaft;

said hosel being integrally attached to said club head;

said club head having an effective center of gravity substantially at the midpoint of the toe and heel boundary limits of said club face;

said heel section being the portion, of said club head, having boundary limits starting at a vertical plane intersecting the effective center of gravity and ending at a heel extremity;

said toe section being the portion, of said club head, having boundary limits starting at a vertical plane intersecting the effective center of gravity and ending at a toe extremity;

said vertical plane being perpendicular to said club face;

said effective center of gravity affording dynamic balancing so that the moment of the toe section momentum equals the moment of the heel section momentum at impact;

said heel section having a fixed non-adjustable configuration affording a weight of from 1.05 to 1.15 greater than a fixed non-adjustable weight of said toe section so that the moment of the heel section momentum equals the moment of the toe section momentum at impact;

said heel section momentum being derived by due consideration to the different velocity of the toe and heel sections at impact;

said toe section momentum being derived by due consideration to the different velocity of the toe and heel sections at impact;

said grip being adhesively attached to said shaft; and said shaft being attached to said club head.

7. The golf club of claim 6, wherein said crown of said club head has a mark or plurality of marks indicating the locus or loci between said vertical plane and the top portion of said crown.

8. The golf club of claim 6, wherein said club face has a distinguishing mark or plurality of marks indicating the location of said effective center of gravity as viewed from the front of said club face.

9. The golf club of claim 6, wherein said crown of said club head has a mark or plurality of marks indicating the locus or loci between said vertical plane and the top portion of said crown, and wherein said club face has a distinguishing mark or plurality of marks indicating the location of said effective center of gravity as viewed from the front of said club face.

10. The golf club of claim 6, wherein the club face has a roll radius of 8 inches to 50 inches and a bulge radius of 8 inches to 50 inches.

11. A golf club head;

said club head being rigidly shaped to define a club face, a heel, a sole, a toe, a crown, and a hosel, a heel section, a toe section, a toe mass section, a heel mass section, and an interconnect;

said club face having a front being adapted to strike a golf ball;

said club face having upper and lower edges, toe and heel boundary limits;

said heel being the portion of said club head where the sole and hosel meet;

said sole defining a bottom surface of said club head which normally rests on the ground when said golf club is held in the address position;

said toe being the part of the club head that is the farthest away from said heel of said club head;

said crown defining a curved top portion of said club head;

said hosel being that portion of said club head that is designed to interfit with said shaft;

said hosel being integrally attached to said club head;

said club head having an effective center of gravity substantially at the midpoint of the toe and heel boundary limits of said club face;

said heel section being the portion, of said club head, having boundary limits starting at a vertical plane intersecting the effective center of gravity and ending at a heel extremity;

said toe section being the portion, of said club head, having boundary limits starting at a vertical plane intersecting the effective center of gravity and ending at a toe extremity;

said vertical plane being perpendicular to said club face;

said effective center of gravity affording dynamic balancing so that the moment of the toe section momentum equals the moment of the heel section momentum at impact;

said heel section having a weight of from 1.05 to 1.15 greater than the weight of said toe section;

said toe mass section having a concentrated weight of from 7 to 30 percent of the weight of said club head and being located at the proximity of the toe;

said heel mass section having a concentrated weight of from 10 to 33 percent of the weight of said club head and being located at the proximity of the heel;

said interconnect rigidly connecting said toe mass section to the heel mass section, traversing substantially through a horizontal plane intersecting said effective center of gravity;

said interconnect being an intrinsic part of said club head and having a rearward dimension measured horizontally from the club face along said vertical plane of at least 0.5 inch affording a high moment of inertia interconnect;

12. The golf club of claim 11, wherein said crown of said club head has a mark or plurality of marks indicating the locus or loci between said vertical plane and the top portion of said crown.

13. The golf club of claim 11, wherein said club face has a distinguishing mark or plurality of marks indicating the location of said effective center of gravity as viewed from the front of said club face.

14. The golf club of claim 11, wherein said crown of said club head has a mark or plurality of marks indicating the locus or loci between said vertical plane and the top portion of said crown, and wherein said club face has a distinguishing mark or plurality of marks indicating the location of said effective center of gravity as viewed from the front of said club face.

15. The golf club of claim 11, wherein the club face has a roll radius of 8 inches to 50 inches and a bulge radius of 8 inches to 50 inches.

16. A golf club head;

said club head being rigidly shaped to define a club face, a heel, a sole, a toe, a crown, and a hosel, a heel section, a toe section;

said club face having a front being adapted to strike a golf ball;

said club face having upper and lower edges, toe and heel boundary limits;

said heel being the portion of said club head where the sole and hosel meet;

said sole defining a bottom surface of said club head which normally rests on the ground when said golf club is held in the address position;

said toe being the part of the club head that is the farthest away from said heel of said club head;

said crown defining a curved top portion of said club head;

said hosel being that portion of said club head that is designed to interfit with said shaft;

said hosel being integrally attached to said club head;

said club head having an effective center of gravity substantially at the midpoint of the toe and heel boundary limits of said club face;

said heel section being the portion, of said club head, having boundary limits starting at a vertical plane intersecting the effective center of gravity and ending at a heel extremity;

said toe section being the portion, of said club head, having boundary limits starting at a vertical plane intersecting the effective center of gravity and ending at a toe extremity;

said vertical plane being perpendicular to said club face;

said effective center of gravity affording dynamic balancing so that the moment of the toe section momentum equals the moment of the heel section momentum at impact;

said heel section having a fixed non-adjustable configuration affording a weight of from 1.05 to 1.15 greater than a fixed non-adjustable weight of said toe section so that the moment of the heel section momentum equals the moment of the toe section momentum at impact;

said heel section momentum being derived by due consideration to the different velocity of the toe and heel sections at impact;

said toe section momentum being derived by due consideration to the different velocity of the toe and heel sections at impact.

17. The golf club of claim 16, wherein said crown of said club head has a mark or plurality of marks indicating the locus or loci between said vertical plane and the top portion of said crown.

18. The golf club of claim 16, wherein said club face has a distinguishing mark or plurality of marks indicating the location of said effective center of gravity as viewed from the front of said club face.

19. The golf club of claim 16, wherein said crown of said club head has a mark or plurality of marks indicating the locus or loci between said vertical plane and the top portion of said crown, and wherein said club face has a distinguishing mark or plurality of marks indicating the location of said effective center of gravity as viewed from the front of said club face.

20. The golf club of claim 16, wherein the club face has a roll radius of 8 inches to 50 inches and a bulge radius of 8 inches to 50 inches.

* * * * *